United States Patent [19]

Denman et al.

[11] Patent Number: 4,544,136

[45] Date of Patent: Oct. 1, 1985

[54] TIRE LIFT/CARRIER

[75] Inventors: Stephen A. Denman, Centerville; Jack J. Powell, Kettering, both of Ohio

[73] Assignees: Joseph Deuer; James Deuer, both of Dayton, Ohio

[21] Appl. No.: 554,278

[22] Filed: Nov. 22, 1983

Related U.S. Application Data

[63] Continuation of Ser. No. 277,088, Jun. 25, 1981, abandoned.

[51] Int. Cl.[4] ..... B66D 1/04; B66D 1/34; B66D 1/54

[52] U.S. Cl. ..... 254/323; 192/80; 224/42.24; 242/117; 242/118.6; 242/118.8; 242/125.1; 254/342; 414/463; 464/77

[58] Field of Search ..... 242/86.5, 74, 117, 118.6, 242/118.62, 118.8, 125.1, 125; 254/325, 324, 326, 327, 342, 344, 370; 414/463, 466; 464/73, 77, 84; 192/53, 79, 80; 224/42.43, 42.24, 42.29

[56] References Cited

U.S. PATENT DOCUMENTS

| | | | |
|---|---|---|---|
| 939,734 | 11/1909 | Muller | 242/118.4 |
| 2,894,610 | 7/1959 | Harrington | 254/903 |
| 3,088,689 | 5/1963 | Perlini | 242/118.61 |
| 3,135,478 | 6/1964 | Harlander | 242/117 |
| 3,272,454 | 9/1966 | Lane et al. | 242/125.1 |
| 3,352,508 | 11/1967 | Hadley | 242/125.1 |
| 3,539,152 | 11/1970 | Paul | 254/323 |
| 3,542,413 | 11/1970 | Hardison | 414/463 |
| 3,856,167 | 12/1974 | Yasue et al. | 414/463 |
| 3,874,536 | 4/1975 | Watanabe | 414/463 |
| 3,973,740 | 8/1976 | Schankler | 242/74 |
| 4,059,197 | 11/1977 | Iida | 414/463 |
| 4,174,797 | 11/1979 | Yasue et al. | 224/42.23 |
| 4,222,246 | 9/1980 | Rongley | 464/77 |
| 4,249,682 | 2/1981 | Yasue et al. | 224/42.23 |
| 4,266,740 | 5/1981 | Ramos et al. | 242/86.5 R |

*Primary Examiner*—Billy S. Taylor

*Attorney, Agent, or Firm*—Jerome P. Bloom

[57] ABSTRACT

The invention relates to a new and improved tire lift-/carrier featuring a reel assembly comprised of a rotatable spool formed of thin metal plates abutted one to the other in a side by side relation, a portion of which plates defines a cavity in which one end of a line is held captive, the other end of which line is adapted to extend to releasably connect to a load which places a tension on this line in use. In the preferred embodiment described the spool has a single track within which the single line in connection with the spool is constrained to wrap directly on itself. The connection of the line to the spool is such that the spool may be rotated in either of opposite directions and in either case the line will wrap smoothly on itself. In the preferred embodiment illustrated the spool has a press fit gear through the medium of which it is driven in either of its opposite directions of rotation. This press fit gear is illustrated as driven by an orbiting gear under the influence of the shaft about which the spool rotates. In a particularly preferred embodiment the drive mechanism for the spool includes a simple torque limiting device serving as a protective medium for the reel assembly in use.

24 Claims, 11 Drawing Figures

10
12
14
16
19
20
20'
21
22
22'
24
26
28
30
34
36
38
40
42
44
46
48
50
52
56
56'
58
59
63
65
68
70
72
73
74
76
76'
77
78
80
90
92
94
96
98
100
W
2
3

FIG-6
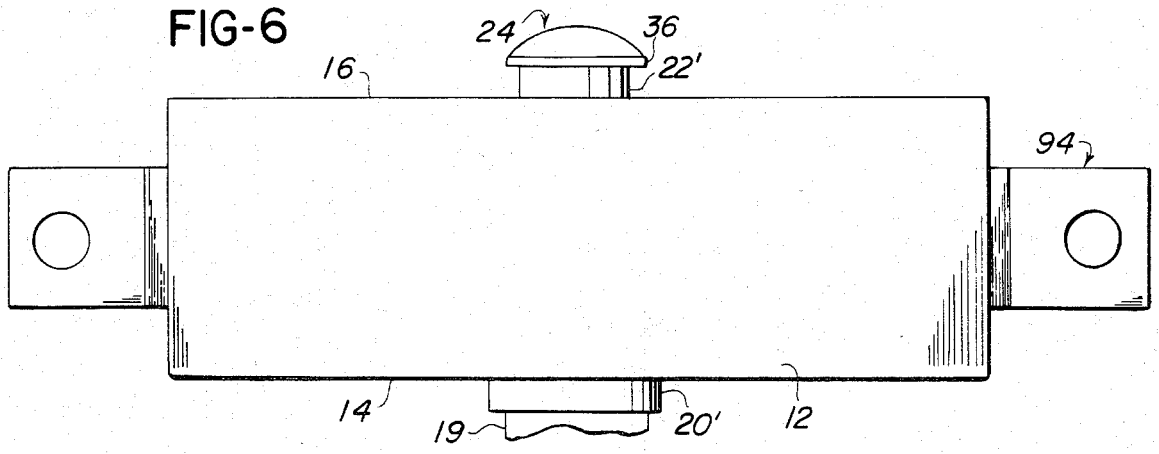
FIG-3
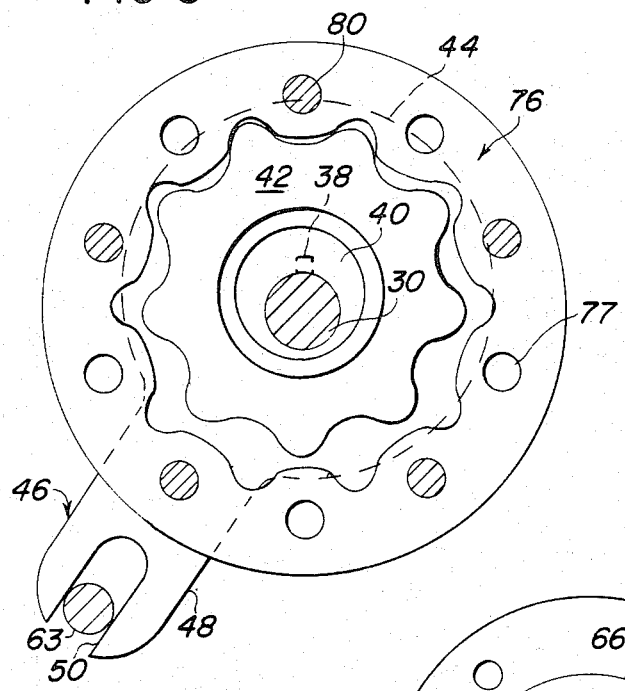
FIG-4
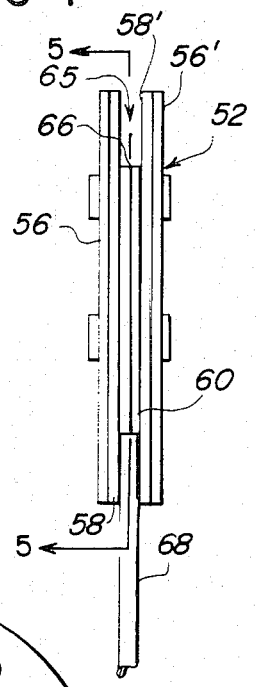
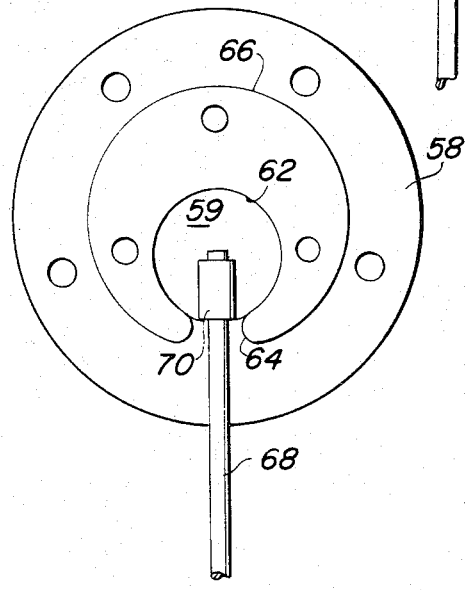
FIG-5

TIRE LIFT/CARRIER

This application is a continuation, of application Ser. No. 06/277,088, filed june 25, 1981 now abandoned.

BACKGROUND OF THE INVENTION

This invention relates to a new and improved tire lift/carrier. Its embodiments feature a reel assembly which is simple and economical to fabricate, more efficient and satisfactory in use and unlikely to malfunction. In its embodiment to provide a tire lift/carrier it provides a solution to problems which have heretofore existed in this particular art. It will therefore be so described for purpose of illustration but not by way of limitation either as to the form of its embodiment or its application.

The storage of a spare wheel in a truck has always been a problem. Designers have found it exceedingly difficult to mount the spare wheel so as to make it accessible and easy to retrieve and replace. A partial solution to the problems in this respect was found in the advent of the manufacture and use of a chain-type hoist to use as a tire lift/carrier. However, such devices as previously contrived have proven to be relatively costly to fabricate and a burden on the manipulator in that they are heavy in weight and cumbersome in use and less than satisfactory in their operation. Their construction has oftentimes been such to lead to jamming of their parts or weakening of their supports due to their inadvertent misoperation by untrained personnel. By contrast, the tire lift/carriers of the present invention can be simply operated by the most inexperienced of persons, and without serious danger to the manipulator and negligible chance of damage to the equipment involved.

SUMMARY OF THE INVENTION

As previously noted, one embodiment of the present invention provides a tire lift/carrier which can be used for the storage and retrieval of the spare wheel of a truck or automobile. The construction of this embodiment is such to require a minimal amount of space and to facilitate its easy installation and manipulation by persons having little mechanical skill or knowledge. In its most advantageous form it features the use of a single line of what is known as "aircraft" cable as its suspension element.

More particularly, the preferred embodiment of this spare wheel storage and retrieval device includes a reel assembly comprising a rotatable spool mounting for rotation in either of opposite directions to which is connected a single line one end of which is held captive to the spool and the other end of which is adapted to releasably connect to a load which places a tension on the line in use. The structure by which the line is held captive to the spool accommodates the wrapping of this line upon the spool when the spool is rotated in either of opposite directions. The spool is so constructed to define a single track within which the line is constrained to wrap directly on itself from an extended position, irrespective of the direction of rotation of the spool. The preferred embodiment of the tire lift/carrier of the invention utilizes a spool comprised of thin metal plates abutted one to another in a side by side relation, a portion of which plates defines a cavity within which one end of the connected line is held captive. As described herein, the spool is driven through the medium of a gear which forms an extension thereof and is coupled thereto without need of separate fasteners. This gear is driven by an orbiting gear the orbiting pattern of which is induced through the medium of a drive shaft about which the spool rotates in use. As will be seen, a preferred construction of a reel assembly per the present invention comprises a laminated spool consisting of a series of thin plates abutted one to the other the outermost of which have a central aperture and a portion of the plates within said outermost plates has an opening larger than and offset from the aperture in the outermost of said plates the center of which is offset from the centers of the apertures in the outermost of said plates.

In cases where a safety control is desirable to prevent undue stress and damage to the reel assembly and its parts in use thereof, the invention embodiments will incorporate a torque limiting device. Such torque limiting device as herein contemplated, by way of example, will be interposed between the orbiting gear above described and its drive shaft.

While herein described with reference to limited form and application, embodiments of the invention may obviously be variously contrived utilizing the teachings of the present disclosure and may be variously applied to serve as tensioning, pulling, suspension, lifting and/or storing devices.

It is therefore a primary object of the invention to provide a reel assembly embodiments of which are suitable for use in applying tension, pulling, suspending, lifting and storing applications. Another object is to provide a reel assembly which is economical to fabricate, most efficient and satisfactory in use, adaptable to a wide variety of applications, and unlikely to malfunction.

A further object is to provide a new and improved tire lift/carrier in the nature of a device for the storage and retrieval of the spare wheel of a truck.

Another object is to provide a uniquely comprised reel assembly which is laminated as to its component parts and so contrived as to facilitate their assembly and interrelation in a simple and most effective manner.

An additional object of the invention is to provide a new and improved reel assembly embodying an orbiting drive mechanism the components of which enable a highly compact and lightweight construction which is simple to operate and rugged in form. A further object is to provide the drive mechanism of the reel assembly with an embodied torque limiting device which is simple and effective in operation.

Another object is to provide a new and improved reel assembly and construction of its component parts exhibiting the advantageous features, the inherent meritorious characteristics and means and method of its use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not the only form of embodiment and application of the invention is illustrated, FIG. 1 is a side elevation view of a tire lift/carrier device in accordance with the present invention;

FIG. 3 is a view taken on line 3—3 of FIG. 2;

FIG. 4 is an elevation view of the spool embodied in the construction shown in FIGS. 1-3;

FIG. 5 is a view taken on line 5—5 of FIG. 4;

FIG. 6 is a top view of the device shown in FIG. 1;

Like parts are indicated by similar characters of reference throughout the several views.

DESCRIPTION OF THE PREFERRED EMBODIMENT ILLUSTRATED IN THE ACCOMPANYING DRAWINGS

Figures 1, 2:
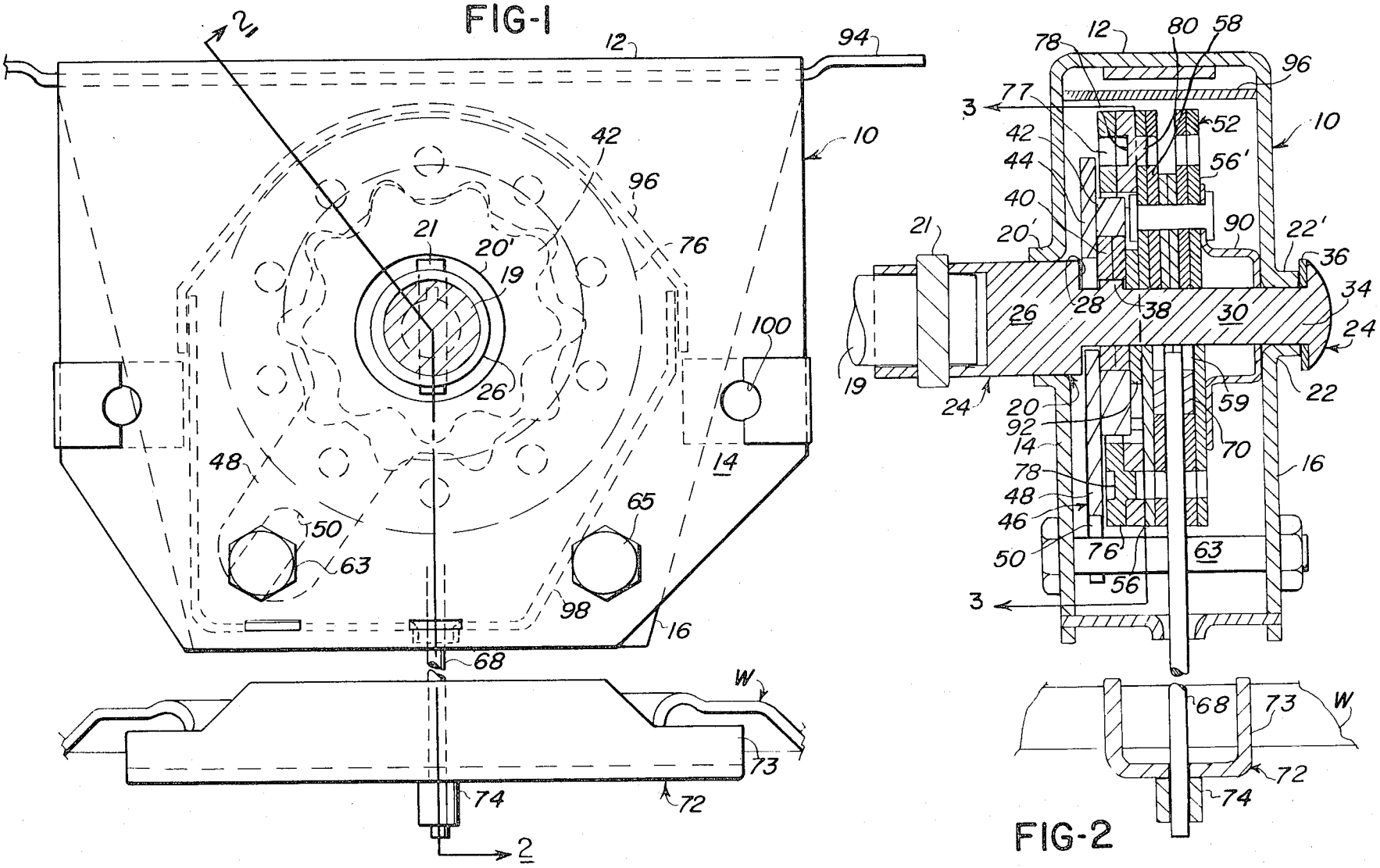
FIG. 2 is a view taken on line 2—2 of FIG. 1.
Figure 7:
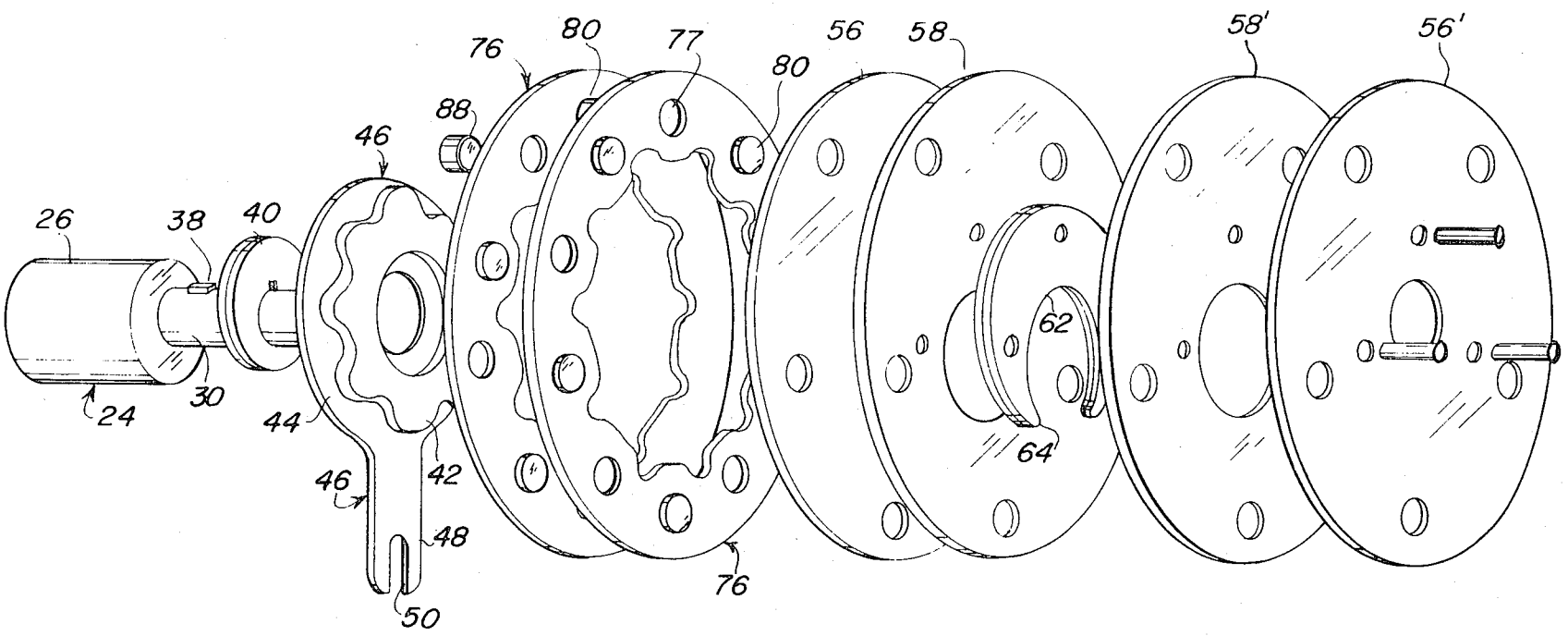
FIG. 7 is an exploded view of the essential components of the reel assembly.

The embodiment illustrated includes a housing 10, an outer portion of which is defined by a plate bent into a channel shape to include a bridging portion 12 which is flat, narrow in width and at right angles to projecting parallel leg portions 14 and 16. The leg portions of this channel-shaped plate each has a central aperture and these apertures are directly aligned. In the forming of these apertures, the aperture 20 thereof in the leg portion 14 is made larger than the aperture 22 in the leg portion 16 and each of these apertures has a tubular rim identified in the drawings by a corresponding number bearing a prime symbol.

As will be seen, the leg portions 14 and 16 provide the closely spaced side walls of the housing 10 between which the operating components of the invention embodiment herein illustrated are contained. For convenience of description the leg portions 14 and 16 will be referred to hereinafter as the housing side walls.

The housing side walls 14 and 16 are bridged by a shaft 24 which projects through the apertures 20 and 22 and bears for rotation in the rims 20' and 22'. The rims project outwardly from the respective side walls.

In view of the differential size of the apertures 20 and 22 and their respective rims, shaft 24 has a stepped diameter. The one end portion 26 of the shaft which bears in and projects outwardly of the rim 20' is that portion which exhibits its largest diameter and its outermost extremity is counterbored to receive one end of a crank 19. Crank 19 is coupled to the shaft by a transversely applied pin 21.

The shaft portion 26 exhibiting its largest diameter, which extends from the crank 19 inwardly of the housing 10, terminates within the space between the side walls 14 and 16 in a plane parallel to and immediately adjacent the inner surface of the wall 14, beyond which the shaft is reduced in diameter. This reduction in diameter provides an annular shoulder 28 defining one end of a reduced diameter portion 30 of the shaft which extends to and through the rim 22'. The extent 34 of shaft portion 30 beyond the rim 22' and projected outwardly of the side wall 16 is relatively short in length.

In the course of assembly of shaft 24 to the housing 10, between the side walls 14 and 16 it passes through and mounts the essential parts of a reel assembly and its drive mechanism which will be further described. When the shaft is assembled, a washer 36 is applied over the end portion 34 which projects outwardly of the rim 22'. Subsequent to the application of the washer 36 the shaft end portion 34 is upset to provide it as an expanded end of the shaft which confines the washer between it and the outwardly projected end of the rim 22'.

The shaft portion 30 embodies a generally rectangular key 38 which projects radially thereof in an adjacent spaced parallel relation to the shoulder 28. When the shaft is assembled to the housing 10, the key 38 positions in adjacent spaced parallel relation to the wall 14.

A disc formed cam 40 having therein an eccentrically positioned aperture the bounding wall of which has a notch which receives therethrough the shaft portion 30 to have the projecting portion of the key 38 wedge in said notch. In this manner the cam 40 is keyed to and fixed eccentrically of the shaft 24 in the plane of the key 38. Mounted about and in bearing relation to the outer peripheral edge of the cam 40, and in a generally co-planar relation therewith, is an annular element having the form of an external gear 42. The gear 42 has one face thereof fixed to one face of an annular portion 44 of a control plate 46, in bounding spaced relation to its central aperture. The control plate 46 is completed by an arm portion 48 which projects radially of its annular portion 44. The radially outermost extremity of the arm portion 48 is bifurcated to define therein an inwardly directed longitudinally extended notch 50.

Referring to FIGS. 1 and 2 of the drawings, the side walls 14 and 16 of the housing 10 are bridged at locations adjacent and spaced from their edges most remote from the bridging plate portion 12 by a pair of bolts, respectively 63 and 65. The bolts 63 and 65 are arranged in lines which are parallel to each other and in a common plane which is parallel to that of the plate portion 12. At the same time, the lines of the bolts 63 and 65 are spaced equidistantly from and substantially outward of a plane which bisects and extends perpendicular to the side walls 14 and 16 as well as the plate portion 12. Noting FIG. 2 of the drawings, the heads of the bolts are abutted to the external surface of the side wall 14 and nuts are applied to their threaded extremities which project outwardly of the side wall 16 to clamp therebetween the sides of the housing 10.

The bolt 63 serves another function in that the control plate 46 is so disposed within the housing 10 and about the shaft portion 30 as to have the bifurcated extremity of its arm 48 receive in the notch 50 thereof a smooth portion of the body of the bolt adjacent and spaced from the side wall 14. On rotation of the shaft 24 through the medium of the crank 19, the cam 40 which is keyed to the shaft will rotate to produce an orbiting eccentric movement of the gear 42 and the annular portion 44 of the control plate 46. In the process there will be a reciprocatory movement of the arm 48 during which it will bear upon the body of the bolt 63 in obvious manner and be restrained thereby from rotation with the shaft 24.

A spool 52 mounts to and about the shaft portion 30 in an adjacent spaced relation to the side of the key 38 remote from the control plate 46. In the case illustrated the spool 52 is composed of six thin metal plates face abutted and secured together in side by side relation by rivets 54. The outermost plate 56 of the spool 52 which is most adjacent the cam 40 and the gear 42 has an annular form providing therein a central aperture the dimension of which is to establish it in a substantially bearing relation to the shaft portion 30. The immediately abutted and next following plate 58 of the spool has a disc form the outer diameter of which is identical with that of the disc 56. The plate 58 also has an aperture but this aperture is substantially larger than that in the plate 56 and it is eccentrically positioned. The outermost spool plate 56' of the spool 52 which is most remote from the plane of cam 40 is identical in size and configuration with the plate 56. Similarly the spool plate 58' which abuts and is immediately inward of the plate 56' has a size and configuration identical with that of the plate 58. Sandwiched between the plates 58 and 58' are two thin plates 60 which are identical as to their shape and size and have a crescent shape. The inner edge 62 of each of the crescent shaped plates is formed on a uniform radius corresponding to the radius of the eccentrically positioned aperture in the plates 58 and 58'. The arcuate extent of the edge 62 is approximately 330° and the respective ends 64 of the crescent shapes are each rounded and formed as an arc of substantially uniform radius. As will be seen, in a plane bisecting the face abutted and aligned crescent shaped plates 60 in a position centered between the crescent extremities 64 of the plate 60 we find the central portion of the plates 60 which exhibit the maximum depth of the crescent shape. This depth is substantial and from this center the crescent shape is rapidly tapered to the tips of the crescent.

In the assembly of the plates of the spool corresponding parts of identical plates are directly aligned. A pocket 59 defined by the plates 60 by virtue of their crescent shape is fixed in a direct alignment with the eccentrically positioned apertures in the plates 58 and 58' which immediately contain the plates 60 therebetween. In turn, the eccentrically positioned apertures in the plates 58 and 58' are so positioned to have a portion of the bounding edge thereof align with a portion of the bounding edge of the smaller apertures in the plates 56 and 56' which form the outermost plates of the spool. The arrangement is such that the spool has side portions comprised of the plates 56 and 58 on the one hand and plates 56' and 58' on the other, intermediate of which is sandwiched the reduced diameter portion of the spool defined by the plates 60. By virtue of this construction, the spool is designed to provide a single track 65 the base of which is defined by the outer peripheral edges 66 of the plates 60 to provide an annular space the width of which is essentially that and only very slightly larger than the diameter of the line 68 applied to the spool to serve as a tensioning, pulling, lifting and storing medium in conjunction with the spool.

Referring to FIG. 5 of the drawings, it may there be seen that in the case illustrated the line 68 is a single length of cable over one end of which is fixed a metal sleeve 70. In the course of the assembly of the spool and following the superposition of the side plates 56 and 58 and stacking thereon of the plates 60, the end of the single length of cable 68 mounting the sleeve 70 is inserted in the pocket 59 defined by the crescent shaped plates 60. In the process the sleeve is projected in part into the eccentrically positioned aperture in the plate 58. When the plates 58' and 56' are superposed over the assembled structure just described, the sleeve 70 is confined within the pocket 59 as a portion of the sleeve 70 opposite that positioning in the eccentrically positioned aperture in the plate 58 is accommodated in the same aperture in the plate 58'. Once the total spool assembly is secured together by rivets accommodated in aligned apertures in the plates of the spool, the sleeve 70 the dimension of the diameter of which is greater than the thickness of the superposed plates 60 bears on the plate surfaces rimming the apertures in the plates 58 and 58'. In this manner not only the sleeve 70 but the end of the single length of cable to which it is secured is retained within the spool and movable within the cavity defined by the pocket of the cresent shaped plates 60 and within the 30° limit established by the spacing of the ends of the crescent shaped plates. The crescent ends 64 correspondingly define a radial opening from the pocket 59.

Referring to FIG. 2 of the drawings, when the line 68 is extended as shown, the pocket 59 opens directly downward of the spool and its housing. In such case the line depends vertically, passing between the crescent ends, to have its lower extremity pass through an aperture centered in the base of a narrow channel shaped plate 72, the arms of which are directed upwardly of its base which seats to one end of a metal sleeve 74 secured to the end of the cable 68 remote from the sleeve 70.

The channel shaped plate 72 has the upper edges of its parallel arm portions 73 cut back to about half depth at each of their respective ends to form thereon generally trapezoidal configured projections at their centers which are equidistantly spaced from their extremities. The projected edge portions of the trapezoidal projections of the arms of the plate 72 commonly lie in a plane parallel to the base of the channel of which they are formed a part, as do the co-planar edges of the cut back portionsof the upper edges of the arms 73. Note that the longitudinal extremities of the trapezoidal portions of the arms 73 are convergent in an upward sense. As seen in FIG. 1, this construction facilitates the insertion of the narrow channel form of the plate 72 within a central aperture in a tire mounting wheel W. To insert the plate 72 it is first angularly inclined until it can pass through the wheel opening after which it is then horizontally positioned to cause the cut back extremities of the arms of the channel member to underlie portions of the wheel structure W which bound its central aperture. The rim of this central aperture in the wheel will then inherently lie immediately adjacent the upwardly angled edges of the trapezoidal projections of the arms 73. Not only does this provide a good underlying support for the wheel W but it precludes a lateral shifting of the wheel with reference to its support 72 in the raising and lowering thereof, as needs require.

A further addition to the component structure embodied about the shaft portion 30 is a laminated, ring-shaped, internal gear 76. The gear 76 is comprised of two thin metal annular plates each of which has an identical gear form and includes therein a circularly arranged series of five equidistantly spaced apertures 77. Intermediate of successively adjacent apertures 77 in each plate is a plate portion partially punched to form a socket 78 in one face thereof and by virtue of the partial punch a cylindrical projection 80 from its opposite face which is complementary in shape and configuration to the socket 78. The plates forming the internal gear 76 are assembled together by rotating one relative the other to align projections 80 from one with sockets 78 in the other, whereupon the plates may be brought together in a male-female press fit relation. This creates an assembly of an internal gear wherein on one face thereof there are five projections 80 which are then press fit in accommodating apertures formed in the plates 56 and 58. In this process the laminated internal gear 76 is secured without the need for separate fasteners to form a extension of the spool at the side thereof most adjacent the side wall 14 of the housing 10. As provided within the housing 10 the internal gear 76 projects to position about and eccentrically of the external gear 42. As may be seen from FIG. 3 of the drawings, the relative position of the internal and external gears as here provided is such that upon orbiting of the gear 42, on rotation of the shaft 24 and its connected cam 40, teeth of the gear 42 will in such orbiting movement exert a driving influence on the teeth of the internal gear 76 in either direction of rotation of the shaft 24. Correspondingly, by virtue of the drive of the gear 76, due to its coupling to form an extension of spool 52 the spool will be correspondingly driven.

It will be seen, referring to FIG. 5 of the drawings, that by the unique arrangement and shape of the crescents 60 latitude is provided for the movement of the end of the cable 68 in the pocket of the crescents and in the cavity defined in the spool which enables it to freely move in the wrapping of the cable about the plates 60 and upon itself within the single track of the spool as the spool rotates. Irrespective of the direction in which the spool is rotated upon drive thereof through the medium of the internal gear 76, the free disposition of the cable end within the cavity in the spool will permit the cable end to angle and permit the portion of the cable passing between the ends of the crescent shape to wrap smoothly around the crescent tips and enable a highly compact winding of the single line 68 within the track 65 in a wrapping procedure. At the same time, the arrangement of the single track which is limited in width insures an alignment of the length of the cable which extends from the track. This leads to stability of the line and positive control of the load which places it under tension in either a lifting or lowering function of the apparatus described. The whole construction lends itself to being fabricated in a highly compact, simple and most efficient fashion. Safety in the use of the apparatus and minimal wear which will be incurred in its function should be self-evident. Not only is control of the cable 68 optimized but it may be easily retracted or extended in a very simple fashion and with the application of minimal force to the crank 19, which may be powered in any suitable manner or in the case illustrated manually turned.

For a firm orientation and positioning of the parts assembled about the shaft portion 30, there is applied over the outer face of the spool plate 56', and secured to the spool by the rivets which connect its plates, a dome-shaped cap 90. The dome of this cap is centrally apertured to accommodate the projection therethrough of the shaft 24 and the projected surface of its dome, which peripherally bounds the shaft portion within the housing 10, abuts the inner wall surface of the side wall 16. As will be self-evident, this cap 90 is a spacer which exerts a stabilizing influence on the spool 52 and its connected internal gear 76. By virtue of a spacer washer 92 applied between the plate 56 and the cam 40, the whole construction of the assembly about the shaft portion 30 is firmly and compactly interrelated in a stabilized fashion. This contributes of course to the stability and control of the cable 68 and the load which is applied thereto in the use thereof.

For application of the described apparatus to the bed or frame of a truck to serve as a tire carrier and support for the spare wheel of the truck, for example, a support or mounting strap 94 is inserted in the channel of the plate forming the side walls of the housing 10 to underlie its bridging portion 12, and to extend outwardly therefrom to either end. The outermost ends of the support strap 94 are offset from its intermediate portion in the direction of the outer surface of the plate portion 12 to position, in the application and securing thereof to a frame or wall structure in a co-planar relation to the outermost surface of the plate portion 12. Screws or such mediums may be applied to releasably connect this support strap 94 to the wall or frame structure to which it must apply to orient the reel assembly embodied in the housing 10 in its proper attitude for use. For certain applications the support strap 94 or its equivalent may be fixed to the plate portion 12.

As may be seen from FIG. 1, two complementary strap-like elements 96 and 98 are slipped in the channel of the plate portion providing the side walls of the housing 10 and connected together to form a peripheral housing wall bridging the side walls 14 and 16 and enclosing the structure on that portion of the shaft 24 between the side walls. The straps 96 and 98 are suitably secured together. The ease of their application should be self-evident on inspection of the drawings. A further point of interest is found in the plates of the spool assembly. Take particular note that each of the plates forming the spool 52 has a series of three triangularly positioned apertures which must be mated in order that the plates be properly oriented and connected to form the required arrangement of a spool as previously described.

The embodiment of the invention herein illustrated, and for that matter any embodiment of the present invention, provides a device which is cheaper, more efficient and much lighter in weight than any devices of the prior art applied to similar purposes. The unique composition of a reel assembly as herein described eliminates any need for rotational control stops and parts. The lift, suspension, pulling and tensioning device here provided can be easily operated by people having no previous experience with mechanical devices. If one wishes to lift a load with the cable extended, one can turn the crank in either of opposite directions and achieve the lifting desired. Once the load is lifted to a particular point, as required, the load can be held or stored at that point and the reverse movement of the load will be prohibited by reason of the lock produced as between the gear 42 and the internal gear 76. The mount of the gear 42 inhibits its displacement from its set position in reference to the gear 76. The use of the single line in the present case, as noted previously, produces unusual benefits in that by reason of its single track movement the total energy applied in turning the spool will be reflected in movement of the load, except for most negligible friction loss in the procedure. In particular the laminated construction of the parts and their interrelation enable more accurate and uniform parts as well as an accurate and uniform interrelation of parts from one to the other of the assemblies effected. In the example illustrated one might simply state that there is an epicyclic cam gearing arrangement.

It will be self-evident that the same principles as exhibited in the demonstrated embodiment can be easily incorporated in making various devices the use of which may be primarily for one or more of lifting, suspension, pulling, tightening, tensioning and load control functions. Thus, the embodiments of the invention are extremely versatile as to their form and application.

Note should be taken of the apertures 100 in the side walls 14 and 16 in the example illustrated. These are provided to facilitate fastening and support of the housing 10 by applying fasteners through the apertures 100 to a backing or supporting wall structure or frame.

FIGS. 8 through 11 of the drawings exhibit, respectively, two different modifications of the apparatus illustrated in FIGS. 1 through 7. Essentially, in each case, the modifications relate to substitutes for the shaft 24 and the cam 40 to include a torque limiting device in the drive from the crank 19 to the external gear 42. Otherwise, the apparatus of FIGS. 1–7 and its function remains the same.

Figure 8:
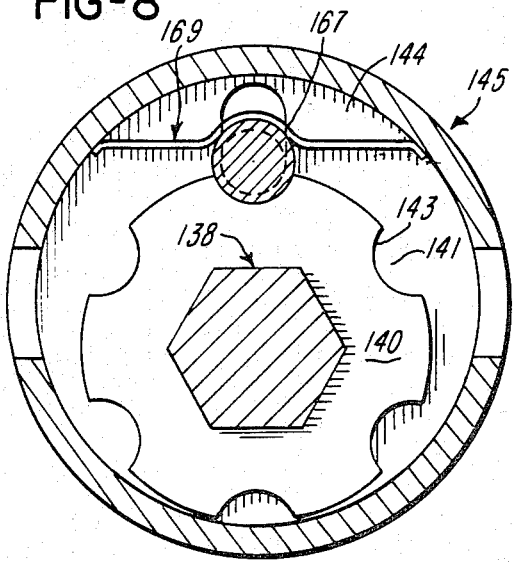
FIG. 8 is a fragmentary cross sectional view illustrating a modification of the embodiment of the invention shown in FIGS. 1-7.
Figure 9:
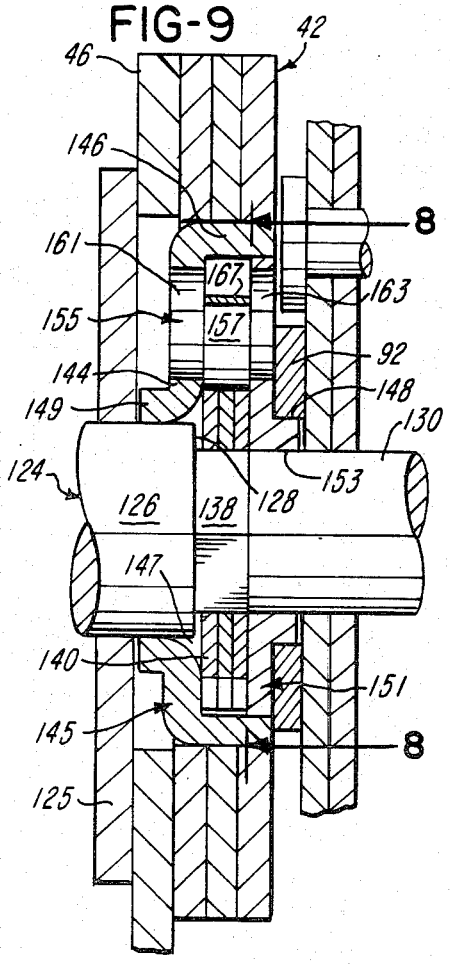
FIG. 9 is a view taken on line 9—9 of FIG. 8.

In the embodiment of FIGS. 8 and 9 a shaft 124 is substituted for the shaft 24. The shaft 124 includes a portion 126 identical to the shaft portion 26, similarly formed and connected at its outermost end to the crank 19. The opposite or inner end of the shaft portion 126 terminates in an annular shoulder 128 corresponding to the shoulder 28. Immediately of the shoulder 128, shaft 124 includes a portion 138 of short axial length. Portion 138 is hexagonal in cross section and its dimension is substantially reduced in a diametral sense as compared to that of the diameter of the shaft portion 126. The remainder of shaft 124, beyond the shaft portion 138, has a diameter which corresponds in dimension to that of the distance between opposed flats on the hexagonal shaft portion 138. In its application to the housing 10, the projected extremity of the shaft portion 130 is terminated in a form and has a function such as exhibited with reference to the shaft 24 in FIG. 2 of the drawings.

A laminated annular rotor unit 140 is press fit over the hexagonal shaft portion 138, the same being facilitated by the complementary configuration of its inner peripheral edge. The outer peripheral surface of the rotor 140, which is otherwise formed on a uniform radius so that it is cylindrical and concentric to the axis of rotation of the shaft 124, is interrupted at each of six equidistantly and circumferentially spaced locations by a notch 141 extending the axial length thereof. Each notch 141 forms a pocket which is defined by a wall 143 which in cross section is formed on a uniform radius and has an arcuate extent of less than 180°.

Rotor 140 nests in a cup-shaped element 145 to seat to the base 144 thereof and orient coaxial with an aperture 147 therein. The aperture 147 is located eccentrically of the cup base and rimmed and axially extended by a coaxial hub-like projection 149 which is formed integral with the base and projects to mount in bearing relation to the shaft portion 126 immediately of the shoulder 128.

At its face remote from the projection 149 the base of the cup-shaped element 145 is rimmed at its outer periphery by an integral perpendicularly projected cylindrical wall structure 146. The wall 146 is eccentrically located with respect to the rotor 140, positioned thereabout and axially projected so its projected extremity terminates a slight distance beyond the axial limit of the rotor. The projected extremity of the wall structure 146 is counterbored to provide it with an outwardly facing annular shoulder. A cap plate 151 suitably secured within the mouth of the cup 145 to seat to this shoulder serves to contain the rotor 140 against endwise movement and to the base 144. The cap plate 151 has an eccentrically positioned aperture 153 accommodating the projection therethrough of the portion 130 of the shaft 124. The portion 130 extends to mount for rotation thereon and relative thereto the reel assembly as first described and exhibited with reference to its mount about the shaft 24. The aperture 153 is axially extended in an outward direction, away from the base of the cup 145, by a cylindrical rimming hub-like projection 148 which is integral with the plate 151. The projection 148 is rimmed by the annular spacer 92 which serves to provide the plate 56 of the reel assembly which is mounted to the shaft 124 with a suitable bearing surface.

A cylindrical pin 155 having an enlarged diameter section 157 intermediate of and equidistantly spaced from its respective ends is shown in FIGS. 8 and 9 to have its enlarged diameter section normally seated in one of the notches 141 in the rotor 140, to the wall 143 thereof. The axial length of the section 157 corresponds to the axial length of the notch 141. The radius of the wall 143 of the notch 141 corresponds to the radius of the pin section 157. In view of the limitation as to the arcuate extent of the cross section of the wall 143, as the pin 155 seats thereon the major extent of its circumference and correspondingly its body projects outwardly of the rotor 140. Thus, less than one-half of its peripheral surface will be accommodated in the notch 141 when the pin is fully seated. The respective ends of the pin 155 will at the time that the pin is seated in a notch 141 project axially to seat respectively in the innermost end of a radial slot 161 in the base 144 of the cup-shaped element 145 and the radially innermost end of a similar and relatively aligned slot 163 in the cap plate 151. Under normal circumstances the pin 155 will be biased to its seat in a notch 141 through the medium of a strap-like spring 169 extending basically in a plane defining a chord of the inner surface of the wall structure 146. The spring 169 is planar in configuration except for its respective ends, which angle divergently and outwardly, in the same direction, to bias to and bear on the inner wall surface of the wall structure 146 as seen in FIG. 9 of the drawings, and a central offset portion 167. The offset of portion 167 is formed on a radius corresponding to that of pin section 157 and defines an arc of less than 180°. Being appropriately configured, offset portion 167 seats to and bears on an outermost portion of the section 157, the axial length thereof. As will be seen from FIG. 8, when the cup 145 and cap plate 151 are suitably secured together, they immediately contain the respective side edges of the spring 169.

Bearing on the outer wall structure 146 of cup 145 which, as described, contains rotor 140 and rotates therewith by virtue of their link by pin 155 is the inner peripheral surface portion of the external gear 42. The description of the gear 42, and its operative coupling to the reel assembly as set forth with reference to FIGS. 1–7 is believed clear and applies equally here.

Apart from the foregoing, the only change of the embodiment of FIGS. 1–7 which results when applying the modification of FIGS. 8 and 9 is the addition of an annular spacer 125 about the shaft 124 between the control plate 46 and the adjacent inner wall surface of the housing 10.

On drive of the crank 19 in the modification of the embodiment of FIGS. 1–7 as seen and described in FIGS. 8 and 9, the cup-shaped element 145 will be driven, normally, through rotor 140 and pin 155. Due to its eccentric connection to shaft 124 cup 145 will serve as did the cam 40, to produce an orbiting eccentric movement of the gear 42 governed by the connection of this gear to the control plate 46. The significance of the substitution of the apparatus shown in FIGS. 8 and 9 for the shaft 24 and cam 40 is seen at such time as an inexperienced or careless person tries to crank the drive shaft, in this instance 124, when the cable of the reel assembly associated therewith has been subjected to an overload, such as when a spare tire might be fully lifted to its optimal height and restrained from further movement by an obstruction. When an overload point is reached, and the crank 19 is subsequently turned, the rotor 140 functions to dislodge the pin 155 from the notch 141 in which it is then seated, against the bias of spring 169. From this point on, as the crank 19 is turned, the rotor 140 will disengage from the cup 145 and free wheel. As long as the overload exists, as the rotor 140 rotates it will disengage the pin 155 therefrom, against the bias thereon by the spring 169, each time the pin attempts to lodge in one of the notches 141.

Accordingly, the invention improvement exhibited in FIGS. 8 and 9 provides a safety device the purpose and benefits of which should be obvious. Not only does it protect against damage to the lift/carrier apparatus but it also insures against breakage of the lift and retention cable employed and the foreseeable consequences of possible injury to the careless operator should a load supported thereby drop.

Figure 10:
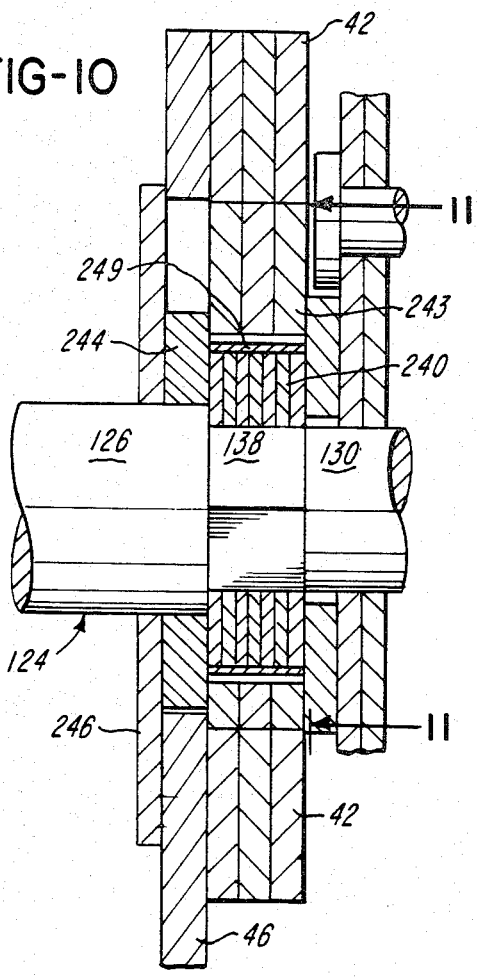
FIG. 10 is a fragmentary sectional view of a second modification of the embodiment of the invention of FIGS. 1-7.
Figure 11:
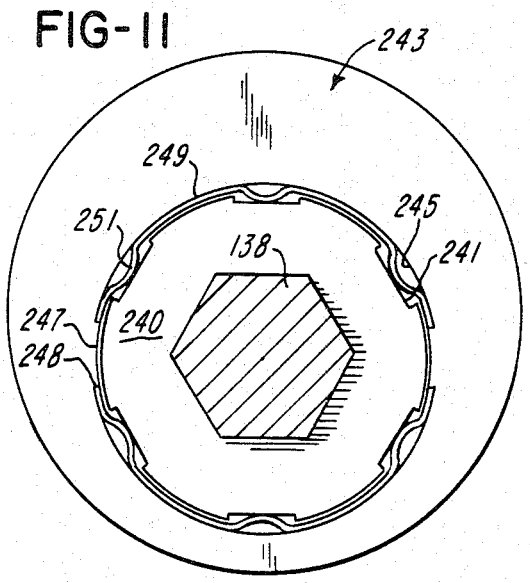
FIG. 11 is a view taken on line 11—11 of FIG. 10.

The apparatus of FIGS. 10 and 11 serves the same purpose as that of FIGS. 8 and 9 just described. Like parts are identified by like numerals. In this modification of the embodiment of FIGS. 1 to 7 the shaft 124 which is substituted for the shaft 24 and connected to the crank 19 and driven thereby is in all respects identical to that illustrated and described with reference to the modification of FIGS. 8 and 9. A laminated rotor 240 is press fit on and coupled to the hexagonal shaft portion 138 in the manner of the rotor 140. The periphery of the rotor 240 embodies six equidistantly and circumferentially spaced notches 241 which extend the axial length thereof and open from each of its opposite ends. In this case, the notches are quite shallow, rectangular in character and laterally extended and the base of each notch is perpendicular to a plane including a diameter of the rotor 240.

In immediately and closely spaced relation to and concentric with the outermost surface portions of the rotor 240 is the cylindrical inner surface 245 of a laminated cam 243. The outermost peripheral surface portion of cam 243 is cylindrical but positioned eccentric to its innermost surface and thereby eccentrically positioned with respect to the rotor 240 and the shaft 124. The outermost surface of the cam 243 positions within and bears on the inner surface of the external gear 42 as did the cup wall 146 in the modification of FIGS. 8 and 9. An annular plate 244 is positioned within an aperture provided in the control plate 46, clear of the bounding wall of such aperture, to position about and in bearing relation to the shaft portion 126 immediately of the shoulder 128. The plate 244 has the outer peripheral portion of its surface most adjacent the cam 243 in bearing abutment with the adjacent face of the cam 243 immediately about its inner periphery. The plate 244 has a thickness substantially equal to that of the control plate 46 and it is held in its bearingly abutted position to the cam 243 by an annular spacer plate 246 which is interposed directly between the control plate 46 and the adjacent inner wall surface of the housing 10. The annular plate 244, by virtue of its position also restricts endwise movement of the rotor 240 and the apparatus interposed between the rotor 240 and the cam 243.

Referring to FIG. 11, it may be there seen that the innermost peripheral surface 245 of the cam 243, which is immediately about the rotor 240, includes a pair of diametrically opposed inwardly directed projections 247 which stop short of the adjacent outer peripheral surface of the rotor 240. The projections 247 include parallel end surface portions 248. To either side of the projections 247 and interposed between thc cam 243 and the rotor 240 in each instance is a spring 249. Lach spring 249 extends a distance less than 180° about the periphery of the rotor 240 and its respective ends are limited to fix the position of the spring in a circular relation by their abutment with the side portions 248 of the projections 247, to one side of the projections. The form of each spring 249 is such that it is generally uniformly arcuate in its end view, as observed in FIG. 11 of the drawings, and formed on a uniform radius about the central axis of the shaft 124, and specifically the hexagonal portion 138 thereof. Intermediate its respective extremities each spring 249 has the major extent thereof outermost and in bearing relation to the surface 245 at the inner periphery of the cam 243. There are three arcuate offsets 251 within the length of each spring which are equidistantly spaced. Each of these offsets are relatively flatly arcuate and under normal conditions will respectively project in and seat to the base of a notch 241.

Thus, under normal conditions, as observed in FIG. 11 of the drawings, the springs 249 essentially serve to provide biased detents in seated relation in the notches at the outer periphery of the rotor 240. The springs are of such a nature and character that when there is an overload on the cable of the reel assembly structure associated therewith, on drive of the shaft 124 and turning of the rotor 240, by reason of the shallow form of the notches 241 the rotor 240 will induce a dislodgement of the offset arcuate portions of the springs 249 and resultingly free wheel. The consequence is insurance against damage to the associated apparatus and undue tensioning of the lift cable which might induce a breaking thereof and eventual loss of the load which it carries.

As in the case of the embodiment of FIGS. 8 and 9, the structure just described is merely to evidence the inclusion of a safety feature by means which substitute for the shaft 26 and the cam 40. There is no other difference contemplated with respect to the apparatus of FIGS. 1–7 which will be associated with and inclusive of the safety apparatus just described.

In any case, the simplicity and effectiveness of the torque limiting apparatus so provided and the benefits thereof are believed self-evident. Unquestionably, where heavy loads are to be lifted and stored or where a stored item is to be based on a moving vehicle which is subject to vibration and/or shock in the movement thereof, it is particularly important that the cable providing a direct connection to the load for lifting and/or support thereof not be unduly stressed or tensioned by careless operation of the crank 19 beyond that point necessary.

Whether the invention embodiments employ a torque limiting device such as illustrated in FIGS. 8 and 9 or 10 and 11, they nevertheless afford an extremely simplistic and relatively safe device of an economical nature facilitating handling and storing of objects during transport or otherwise. Of course, the invention is particularly advantageous in providing a tire lift/carrier as herein illustrated.

To summarize the basic features of embodiments of the invention, they exhibit economy in fabrication and a lift/carrier construction which is foolproof as to its use, precluding inadvertent damage to the apparatus or serious accident and avoiding extensive maintenance and replacement of parts such as often occurs in utilizing devices and systems of the prior art which may be applied to the same or similar purposes.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privelege is claimed are defined as follows:

1. Apparatus particularly advantageous for use as a tire lift/carrier comprising a spool, means to rotate said spool in each of opposite directions, a cable means one end portion of which is coupled to said spool and a free end portion of which is adapted to be connected to a dependent load which places said cable means under tension as the cable means is wrapped on the spool in a lifting procedure, means forming a part of said spool serving as a device coupling said one end portion of said cable means to said spool and establishing a position of said one end portion of said cable means relative said spool which adapts said spool to smoothly wrap said cable means thereon in either of the opposite directions of its rotation in a lifting procedure, with or without a load being supported by and dependent from said cable means, said spool being comprised of a plurality of thin plates stacked and secured together in a face abutted relation, said means to rotate said spool including thin plate means defining a gear having a press fit connection with and forming an extension of one end of said spool and said thin plate means and said one end of said spool having complementarily shaped projections and sockets which interfit to define therebetween said press fit connection.

2. Apparatus particularly advantageous for use as a tire lift/carrier comprising a spool, means to rotate said spool in each of opposite directions, a cable means one end portion of which is coupled to said spool and a free end portion of which is adapted to be connected to a dependent load which places said cable means under tension as the cable means is wrapped on the spool in a lifting procedure, means forming a part of said spool serving as a device coupling said one end portion of said cable means to said spool and establishing a position of said one end portion of said cable means relative said spool which adapts said spool to smoothly wrap said cable means thereon in either of the opposite directions of its rotation in a lifting procedure, with or without a load being supported by and dependent from said cable means, said spool being a body comprised of thin metal plates abutted one to another in a side-by-side relation, a portion of said plates having the outer peripheral surface portion thereof recessed relative outer peripheral surface portions of other of said plates which are in laterally bounding relation thereto to define thereby a relatively narrow track on which said cable means may be wrapped, said relatively recessed outer peripheral surface portion of said laterally bounded portion of said plates forming the base of said track, an opening in the outer peripheral surface portion of said portion of said plates leading to a pocket formed inwardly thereof which is laterally extended into the bodies of said laterally bounding plates, said cable means including a cable one end portion of which has a sleeve mounted in connection therewith to provide said one end portion of said cable means, said one end portion of said cable means including the sleeve being contained by said spool, within said pocket thereof, said sleeve being constructed and arranged to mount on and in portions of said laterally bounding plates and in bearing relation thereto when said cable is under load, said pocket and said opening being configured to accommodate a freedom of relative movement and changing of angular disposition of said one end portion of said cable means including said sleeve to provide for a smooth bending of said cable means at and about said track as said cable means is wrapped thereon, irrespective of the direction of rotation of said spool.

3. Apparatus for use in providing a tire lift/carrier or the like comprising a plurality of plates secured together in a side-by-side face abutted relation to form the body of a spool, said spool having a passage for receiving therethrough a shaft on which said spool may be mounted in use, outermost of said plates having identical apertures forming parts of said passage the size of which is complementary to the cross section of the shaft to be applied in said passage, plates adjacent and immediately inward of the outermost of said plates having identical apertures forming parts of said passage the cross section of which is larger than that defined by the apertures in said outermost of said plates and the central of said plates being formed with an inner edge the circumferential extend of which is less than 360 and bounds said passage in part and is interrupted by a substantially radial opening which extends to and through a recessed track defined in said spool at the outer periphery of said central of said plates and thin plate means defining an internal gear having a press fit connection to and forming an extension of one end of said spool.

4. Apparatus particularly advantageous for use as a tire lift/carrier comprising a rotatable spool formed of a series of relatively thin plates arranged in a secured side by side substantially coaxial face abutting relation, a line in connection with said spool, an outermost of said series related plates, at one end thereof, defining a gear through which said spool may be driven for rotation thereof on and about a shaft, a portion of said plates bounded by other of said plates having a circumferentially extending outer peripheral edge portion thereof recessed with respect to the outer peripheral limits of said other of said plates to define therewith a substantially annular track in the outer peripheral surface of said spool and provide therein a base on which said line may be wrapped, said base extending in a direction circumferentially of said spool for a distance encompassing the major extent of the 360 degrees of its circumference to provide respective ends of said base which are in an adjacent spaced relation, said adjacent ends of said base being spaced by the outermost limit of a further recess directed inwardly of the outer peripheral edge portion of said bounded portion of said plates, said adjacent spaced ends of said base being respectively relatively smoothly merged with smoothly contoured edge portions of said portion of said plates defining the radially outermost limit of said further recess, said bounding portions of said plates including therein apertures which are substantially aligned and paired in a generally coaxial spaced relation, said line having means at one end thereof portions of which respectively project into paired generally coaxial apertures in said bounding plates to bear on edge portions of said bounding plates which respectively rim said paired apertures thereby to provide for and maintain said connection of said line to said spool as said line is placed under load and to relatively smoothly adjust to readily accommodate the wrapping and unwrapping of said line, the construction and arrangement providing a smooth and facile wrapping of said line in said track, on said base and thereabout, and an unwrapping and extension thereof from said track and said spool in a manner to avoid kinking, undue stress, distortion or displacement of the line from said spool as it moves under load or no load conditions.

5. Apparatus as in claim 4 wherein the width of said track is only slightly greater than the diameter of said line thereby to constrain said line to wrap directly on itself as said spool is rotated to move said line to and from said spool.

6. Apparatus as in claim 4 wherein said portion of said plates has a crescent shape the ends of which are arcuate and provide thereon said contoured edge portions immediately of said base, which contoured edge portions have an arcuate profile smoothly merging in each case with the otherwise substantially uniform arcuate profile of said base.

7. Apparatus as in claim 4 wherein said gear and the following of said series of plates are constructed to couple by means of parts thereof which nest and secure together in a male-female relation by means of a press fit of one to the other.

8. Apparatus particularly advantageous for use as a tire lift/carrier comprising a rotatable spool, a line connected with said spool, said spool comprising relatively thin plates positioned and secured together substantially coaxially of one another in a side by side face abutting series relation, an outermost of said series related plates, at one end thereof, defining a gear through which said spool may be driven for rotation thereof on and about a shaft, a portion of said plates intermediate the axial limits of said spool having a circumferentially extending outer peripheral edge portion thereof recessed with respect to the outer peripheral limits of immediately bounding portions of said plates to define therewith a groove in the outer periphery of said spool the inner limit of which provides a base on which said line is wrapped on said spool, said base extending circumferentially of said spool a distance short of 360 degrees to provide respective ends thereof which are in a relatively adjacent spaced relation, said adjacent ends of said base being spaced by the outermost limit of a further recess directed inwardly of the outermost peripheral surface of said bounded portion of said plates, one end of said line including means thereon serving to connect said line to said spool, said immediately bounding plates respectively including means accommodating the projection therein and the bearing relation thereto of portions of said means on said line thereby to effect the connection of and hold said line captive to said spool and provide for an inherent movement of said one end of said line as said line is wrapped on or unwrapped from said track in use in a manner avoiding kinking, undue stress, distortion or displacement of the line from said spool under either load or no load conditions.

9. Apparatus particularly advantageous for use as a tire lift/carrier comprising a rotatable spool, a line connected with said spool, said spool comprising relatively thin plates positioned and secured together substantially coaxially of one another in a side by side face abutting series relation, an outermost of said series related plates, at one end thereof, defining a gear through which said spool may be driven for rotation thereof on and about a shaft, a portion of said plates intermediate the axial limits of said spool having a circumferentially extending outer peripheral edge portion thereof recessed with respect to the outer peripheral limits of immediately bounding portions of said plates to define therewith a groove in the outer periphery of said spool the inner limit of which provides a base on which said line is wrapped on said spool, said base extending circumferentially of said spool a distance short of 360 degrees to provide respective ends thereof which are in a relatively adjacent spaced relation, said adjacent ends of said base being spaced by the outermost limit of further recess directed inwardly of the outermost peripheral surface of said bounded portion of said plates, one end of said line including means thereon serving to connect said line to said spool, said immediately bounding plates respectively including means accommodating the projection therein and the bearing relation thereto of portions of said means on said line thereby to effect the connection of and hold said line captive to said spool and provide for an inherent movement of said one end of said line as said line is wrapped on or unwrapped from said base in use in a manner avoiding kinking, undue stress, distortion or displacement of the line from said spool under either load or no load conditions, said gear being an internal ring gear having therein a series of punched portions producing sockets in the face thereof outermost of said spool and corresponding projections from the opposite face thereof which are complementary in shape to that of said sockets, said projections being fit in corresponding complementary sockets in the immediately following of said plates and secured thereto, said spool being adapted thereby for drive thereof through the medium of an external shaft driven gear.

10. Apparatus particularly advantageous for use as a tire lift/carrier comprising a rotatable spool, a line connected with said spool, said spool comprising relatively thin plates positioned and secured together substantially coaxially of one another in a side by side face abutting series relation, an outermost of said series related plates, at one end thereof, defining a gear through which said spool may be driven for rotation thereof on and about a shaft, a portion of said plates intermediate the axial limits of said spool having a circumferentially extending outer peripheral edge portion thereof recessed with respect to the outer peripheral limits of immediately bounding portions of said plates to define therewith a groove in the outer periphery of said spool the inner limit of which provides a base on which said line is wrapped on said spool, said base extending circumferentially of said spool a distance short of 360 degrees to provide respective ends thereof which are in a relatively adjacent spaced relation, said adjacent ends of said base being spaced by the outermost limit of a further recess directed inwardly of the outermost peripheral surface of said bounded portion of said plates, one end of said line including means thereon serving to connect said line to said spool, said immediately bounding plates respectively including means accommodating the projection therein and the bearing relation thereto of portions of said means on said line thereby to effect the connection of and hold said line captive to said spool and provide for an inherent movement of said one end of said line as said line is wrapped on or unwrapped from said base in use in a manner avoiding kinking, undue stress, distortion or displacement of the line from said spool under either load or no load conditions, and means at one end of said spool formed to include a part thereof which is compressible under load to readily adapt said spool to compensate for tolerances in the fabrication of its elements being on the high side as said spool is placed within a housing for use thereof.

11. Apparatus as in claim 8 wherein the width of said groove is slightly greater than the diameter of said line thereby to constrain said line to wrap directly on itself as said spool is rotated to draw said line to said spool from an extended position thereof.

12. Apparatus comprising a reel assembly particularly advantageous for use as a tire lift/carrier comprising a rotatable spool, a line connected with said spool, said spool comprising relatively thin plates positioned and secured together substantially coaxially of one another in a side by side face abutting relation, a portion of said plates intermediate the axial limits of said spool having a circumferentially extending outer peripheral edge portion thereof recessed with respect to the outer peripheral limits of immediately bounding portions of said plates to define therewith a groove in the outer periphery of said spool the inner limit of which provides a base on which said line is wrapped on said spool, said base extending circumferentially of said spool a distance short of 360 degrees to provide respective ends thereof which are in a relatively adjacent spaced relation, said adjacent ends of said base being spaced by the outermost limit of a further recess directed inwardly of the outermost peripheral surface of said bounded portion of said plates, one end of said line including means thereon serving to connect said line to said spool, said immediately bounding plates respectively including means accomodating the projection therein and the bearing relation thereto of portions of said means on said line thereby to effect the connection of and hold said line captive to said spool and provide for an inherent movement of said one end of said line as said line is wrapped on or unwrapped from said base in use in a manner avoiding kinking, undue stress, distortion or displacement of the line from said spool under either load or no load conditions, means to rotate said spool including a shaft projected through a passage provided in said spool, said shaft mounting said spool for rotation thereon and relative thereto, means comprising a cam coupled for drive thereof through said shaft, said cam being located in an adjacent relation to one end of said spool, said one end of said spool being provided by one of said plates which embodies therein the form of an internal gear, an external gear mounted to, about and in a bearing relation to said cam, said external gear having control means in connection therewith for producing a limited orbiting movement thereof on rotation of said cam and said external gear being positioned within said internal gear to produce a drive thereof and whereby said spool in correspondence with its orbiting movements.

13. Apparatus as in claim 12 including a clutch device connected for rotation with and drive thereof through said shaft, such clutch device including a rotor having a plurality of notches in its outer periphery, spring means at the outer periphery of said rotor having portions thereof lodged in a plurality of said notches and interposed between said rotor and said means comprising a cam to normally produce a drive of said cam in correspondence with the rotation of said shaft, said means comprising said cam, said spring means and said rotor beings so interrelated to nullify the drive of said cam on a predetermined level of resistance to the rotation of said spool.

14. Apparatus as in claim 12 including a clutch device mounted about and for rotation with said shaft, said clutch device including a rotor having a plurality of notches in its outer periphery, spring means portions of which are normally projected and resiliently biased in notches of said rotor and other portions of which are normally resiliently held in a driving relation to said means comprising said cam.

15. Apparatus as in claim 14 wherein said spring means have means in association therewith to prevent the rotational movement thereof relative one of said rotor and said means comprising said cam and said portions of said spring means lodged in said notches are formed to displace from said notches on a predetermined level of resistance to the rotation of said spool.

16. Apparatus as in claim 12 including a clutch device connected for rotation with and drive thereof through said shaft, said clutch device including a rotor having a plurality of notches in its outer periphery, a pin normally mounted in one of said notches to extend in a line parallel to said shaft and spring means between said pin and said means comprising said cam normally biasing said pin into said rotor to provide the rotation of said cam on a rotation of said shaft and a movement of said rotor relative said pin on the sensing thereby of a predetermined level of resistance to the rotation of said spool.

17. Apparatus as in claim 13 wherein said spring means and said means comprising said cam have means which normally inhibit their relative rotational movement and said spring means and said rotor have means which normally inhibit their relative rotational movement, thereby to normally provide for a positive drive for means comprising said cam through said shaft and said clutch device preventing relative rotational movement of said cam and said rotor in absence of a predetermined level of resistance to rotation of said spool.

18. Apparatus particularly advantageous for use as a tire lift/carrier comprising a rotatable spool, a line in connection with said spool, said spool comprising relatively thin plates positioned and secured together substantially coaxially of one another in a side by side face abutting relation, a portion of said plates intermediate the axial limits of said spool having a circumferentially extending outer peripheral edge portion thereof recessed with respect to the outer peripheral limits of immediately bounding portions of said plates to define therewith a track and provide a base on which said line may wrap about said spool, said base having the circumferential extent thereof, which is otherwise formed on a generally uniform radius for a distance closely approaching 360 degrees, interrupted by a further recess directed inwardly thereof, said recess having its circularly spaced outer limits, which define the relatively adjacent remote ends of said base, defined by smoothly contoured edge portions of said portion of said plates which respectively smoothly merge with said remote ends of said base, said contoured edge portions being formed to extend substantially radially inward of said base immediately thereof, aligned apertures provided in those plate portions which bound said base, said apertures extending in a direction axially of said spool and having at least portions thereof adjacent said base, one end of said line having means extending in a direction transversely with respect to said recess to have portions thereof respectively extend into said aligned apertures of those plate portions which immediately bound said base and to bear therein on bounding surface portions thereof in use of said line, said line being thereby connected and made captive to said spool in a construction and arrangement providing for an inherent adjusting movement of said one end of said line which is held captive to said spool as said line is wrapped on and unwrapped from said base in use thereof.

19. Apparatus as in claim 18 wherein an outermost of said plates to one end of said spool provides an internal ring gear and has in the body thereof a series of punched portions producing sockets in the face thereof outermost of said spool and corresponding projections from the opposite face thereof which are complementary in shape to that of said sockets, said projections being fit in corresponding complementary sockets in the immediately following of said plates and secured thereto, said spool being adapted thereby for drive thereof through the medium of an external shaft driven gear.

20. Apparatus as in claim 18 wherein the width of said track as determined by the width of said base is slightly greater than the diameter of said line thereby to constrain said line to wrap directly on itself as said spool is rotated to draw said line to said spool from an extended position thereof.

21. Apparatus as in claim 18 providing a reel assembly characterized by means to rotate said spool including a shaft projected through a passage defined in said spool by a least a portion of said apertures, said shaft mounting said spool for rotation thereon and relative thereto, means comprising a cam coupled for drive thereof through said shaft, said cam being located in an adjacent relation to one end of said spool, said one end of said spool being provided by one of said plates which embodies therein the form of an internal gear, an external gear mounted to, about and in a bearing relation to said cam, said external gear having control means in connection therewith for producing a limited orbiting movement thereof on rotation of said cam and said external gear being positioned within said internal gear to produce a drive thereof and thereby said spool in correspondence with its orbiting movements.

22. Apparatus as in claim 21 including a clutch device connected for rotation with and drive thereof through said shaft, such clutch device including a rotor having a plurality of notches in its outer periphery, spring means at the other periphery of said rotor having portions thereof lodged in a plurality of said notches and interposed between said rotor and said means comprising a cam to normally produce a drive of said cam in correspondence with the rotation of said shaft, said means comprising said cam, said spring means and said rotor being so interrelated to nullify the drive of said cam on a predetermined level of resistance to the rotation of said spool.

23. Apparatus as in claim 21 including a clutch device mounted about and for rotation with said shaft, said clutch device including a rotor having a plurality of notches in its outer periphery, spring means portions of which are normally projected and resiliently biased in notches of said rotor and other portions of which are normally resiliently held in a driving relation to said means comprising said cam.

24. Apparatus as in claim 23 wherein said spring means and said means comprising said cam have means which normally inhibit their relative rotational movement and said spring means and said rotor have means which normally inhibit their relative rotational movement, thereby to normally provide for a positive drive for means comprising said cam through said shift and said clutch device preventing relative rotational movement of said cam and said rotor in absence of a predetermined level of resistance to rotation of said spool.

* * * * *

UNITED STATES PATENT AND TRADEMARK OFFICE

CERTIFICATE OF CORRECTION

PATENT NO. : 4,544,136

DATED : October 1, 1985

INVENTOR(S) : Stephen A. Denman and Jack J. Powell

It is certified that error appears in the above-identified patent and that said Letters Patent is hereby corrected as shown below:

Col. 6, line 64, "a" is corrected to read -- an --.

Col. 11, line 67, "Lach" is corrected to read -- Each --.

Col. 14, line 33 (Claim 3, line 15), "extend" is corrected to read -- extent --.

Col. 17, line 60 (Claim 12, line 44) "whereby" is corrected to read -- thereby --.

Col. 20, line 35 (Claim 24, line 7) "shift" is corrected to read -- shaft --.

Signed and Sealed this

*Twenty-fourth* Day of *December 1985*

[SEAL]

*Attest:*

DONALD J. QUIGG

*Attesting Officer*

*Commissioner of Patents and Trademarks*